US012409997B2

(12) United States Patent
Abdelhamid et al.

(10) Patent No.: US 12,409,997 B2
(45) Date of Patent: Sep. 9, 2025

(54) CONTAINER FOR STORING PERISHABLE CONTENTS AND METHOD OF MAKING SAME

(71) Applicant: GROUPE CANAPA, Longueuil (CA)

(72) Inventors: Alla Hussein Abdelhamid, Longueuil (CA); Samuel Roberge-Fortin, Longueuil (CA)

(73) Assignees: Alla Hussein Abdelhamid, Longueuil (CA); VERTLIME TECHNOLOGIES INC., Richelieu (CA)

( * ) Notice: Subject to any disclaimer, the term of this patent is extended or adjusted under 35 U.S.C. 154(b) by 119 days.

(21) Appl. No.: 17/923,770

(22) PCT Filed: May 5, 2021

(86) PCT No.: PCT/CA2021/000041
§ 371 (c)(1),
(2) Date: Nov. 7, 2022

(87) PCT Pub. No.: WO2021/223009
PCT Pub. Date: Nov. 11, 2021

(65) Prior Publication Data

US 2023/0202734 A1 Jun. 29, 2023

Related U.S. Application Data

(60) Provisional application No. 63/020,253, filed on May 5, 2020.

(51) Int. Cl.
*A24F 15/12* (2006.01)
*A24F 23/00* (2006.01)
(Continued)

(52) U.S. Cl.
CPC ..... *B65D 81/24* (2013.01); *A24F 15/12* (2013.01); *A24F 23/00* (2013.01); *B65D 1/40* (2013.01);
(Continued)

(58) Field of Classification Search
CPC ..... B65D 81/3841
See application file for complete search history.

(56) References Cited

U.S. PATENT DOCUMENTS 2,493,633 A * 1/1950 Mart ..... B65D 1/265 206/519
4,367,820 A * 1/1983 Yoshino ..... B65D 23/001 220/634
(Continued)

FOREIGN PATENT DOCUMENTS

FR 2903672 A1 * 1/2008 ..... A45D 40/0068
JP 2000335543 A * 12/2000

*Primary Examiner* — Mollie Impink
(74) *Attorney, Agent, or Firm* — PRAXIS

(57) ABSTRACT

A container for storing perishable contents comprising an inner storage chamber defining top and bottom ends and comprising a floor at the bottom end thereof and an inner wall extending from the floor towards an opening at the top end thereof. The floor and the inner wall defining a storage cavity therebetween. An outer wall covers the inner wall and downwardly extends from a junction therewith at or near the top end of the storage chamber towards a bottom edge thereof at or near the bottom end of the storage chamber. The outer wall and the inner wall are spaced apart to define an air channel therebetween for receiving air. The bottom edge of the outer wall and the floor of the storage chamber define an opening therebetween leading to the air channel. The air channel provides for allowing a layer of air between the outer wall and inner wall to act as insulation for the perishable contents.

5 Claims, 6 Drawing Sheets

(51) Int. Cl.

| | |
|---|---|
| ***B65D 1/40*** | (2006.01) |
| ***B65D 6/10*** | (2006.01) |
| ***B65D 8/00*** | (2006.01) |
| ***B65D 43/02*** | (2006.01) |
| ***B65D 81/24*** | (2006.01) |
| ***B65D 81/38*** | (2006.01) |
| ***B65D 85/08*** | (2006.01) |

(52) U.S. Cl.
CPC ..... *B65D 11/04* (2013.01); *B65D 11/16* (2013.01); *B65D 43/0231* (2013.01); *B65D 81/3841* (2013.01); *B65D 85/08* (2013.01)

(56) References Cited

U.S. PATENT DOCUMENTS

| | | | | |
|---|---|---|---|---|
| 5,036,998 | A * | 8/1991 | Dunn | A47G 19/30 D34/1 |
| 7,243,812 | B2 * | 7/2007 | Mansfield | B65D 1/265 206/219 |
| 2004/0084346 | A1 * | 5/2004 | Candy | B65D 21/0213 206/505 |
| 2007/0209331 | A1 * | 9/2007 | Killinger | B65D 11/16 53/474 |
| 2017/0367509 | A1 * | 12/2017 | Achan, Jr. | A47G 19/2261 |
| 2019/0300228 | A1 * | 10/2019 | Tsukatani | B29C 49/48 |

* cited by examiner

CONTAINER FOR STORING PERISHABLE CONTENTS AND METHOD OF MAKING SAME

CROSS-REFERENCE TO RELATED APPLICATIONS

The present application claims priority on U.S. Provisional Application Ser. No. 63/020,253 filed on May 5, 2020 and incorporated herein by reference in its entirety.

TECHNICAL FIELD

The present disclosure generally relates to storing perishable contents such as herbs. More particularly, but not exclusively, the present disclosure relates to a container for storing perishable contents, a method of making this container and a method of storing perishable contents.

BACKGROUND

Containers for perishable goods including herbs such as cannabis are well known and widely available. Currently, these containers are produced by blow molding thermoplastic materials such as High-density polyethylene (HDPE), Polyethylene terephthalate (PET), Polyvinyl chloride type I (PVC-1) and the like. Blow molding is used to make discontinuous hollow bodies such as bottles, containers, and vials. This technology allows to unmold parts with angles that would not otherwise be possible to unmold with art injection molding process. The walls of the containers provided by this technology are relatively thick. Cracks and small holes in the container walls allow for airborne moisture to enter the container. Water vapor may also enter the container walls through diffusion. Water vapor decreases the life cycle of perishable goods such as herbs including cannabis thereby decreasing the freshness period thereof.

OBJECTS

An object of the present disclosure is to provide a container for storing perishable contents such as herbs.

An object of the present disclosure is to provide a method of making a container for storing perishable contents such as herbs.

An object of the present disclosure is to provide a method of storing perishable contents such as herbs.

An object of the present disclosure is to provide a container assembly.

SUMMARY

In accordance with an aspect of the present disclosure, there is provided a container for storing perishable contents comprising an inner storage chamber for receiving the perishable contents therein, the inner storage chamber defining top and bottom ends and comprising a floor at the bottom end thereof, an inner wall extending from the floor towards an opening at the top end thereof, the floor and the inner wall defining a storage cavity therebetween; and an outer wall covering the inner wall and downwardly extending from a junction therewith at or near the top end of the storage chamber towards a bottom edge thereof at or near the bottom end of the storage chamber, the outer wall and the inner wall being spaced apart so as to define an air channel therebetween for receiving air, the bottom edge of the outer wall and the floor of the storage chamber defining an opening therebetween leading to the air channel; wherein the air channel provides for allowing a layer of air between the outer wall and inner wall to act as insulation for the perishable contents. In an embodiment, the container further comprises interconnectors between the outer wall and inner wall. In an embodiment, the container further comprises a spout at the top end of storage defining the opening leasing to the storage cavity.

In an embodiment, the container further comprises interconnectors between the outer wall and inner wall. In an embodiment, each interconnector extends along a length of the outer wall and comprises an upper part thereof connected to the inner wall and a lower part thereof that is not connected tot the inner wall. In an embodiment, the interconnectors are spaced apart.

In an embodiment, the container further comprises a spout at the top end of storage defining the opening leading to the storage cavity. In an embodiment, the opening is releasably sealable by a closure cover.

In an embodiment, the air channel size expands along the length of the inner storage chamber from a position near or at the junction to a position near or at the bottom edge thereof at or near the bottom end of the storage chamber. In an embodiment, the air channel size retracts along the length of the inner storage chamber from a position near or at the junction to a position near or at the bottom edge thereof at or near the bottom end of the storage chamber. In an embodiment, the air channel size is similar along the length of the inner storage chamber from a position near or at the junction to a position near or at the bottom edge thereof at or near the bottom end of the storage chamber.

In accordance with an aspect of the present disclosure, there is provided a method of making a container for perishable contents, the method comprising: providing an inner storage chamber for receiving the perishable contents therein, the inner storage chamber defining top and bottom ends and comprising a floor at the bottom end thereof, an inner wall extending from the floor towards an opening at the top end thereof, the floor and the inner wall defining a storage cavity therebetween; and providing an outer wall covering the inner wall and downwardly extending from a junction therewith the at or near the top end of the storage chamber towards a bottom edge thereof at or near the bottom end of the storage chamber, the outer wall and the inner wall being spaced apart so as to define an air channel therebetween for receiving air, the bottom edge of the outer wall and the floor of the storage chamber defining an opening therebetween leading to the air channel.

In accordance with an aspect of the present disclosure, there is provided a method of storing perishable contents, the method comprising: storing the perishable contents within an inner storage chamber comprising an inner wall extending from a floor and defining a storage cavity therebetween; and providing a layer of air between the inner wall and an outer wall covering the inner wall and being spaced therefrom to provide an air channel therebetween for receiving air, the air acting as insulation for the perishable contents; and allowing air to enter the air channel via an opening defined between a bottom edge of the outer wall and the floor.

The layer of air between the outer and inner wall of the container provides for a layer of air insulation for the perishable contents within the storage chamber thereby reducing the water vapor transmission ratio and increasing the freshness time period of the perishable contents. The double spaced walls structure with air channel therebetween provides for reducing costs and manufacturing time of the containers herein.

In accordance with an aspect of the present disclosure, there is provided a container assembly for perishable contents including rolled smokable cylinders of burnable material, the assembly comprising: at least one pair of a first and second containers being adjacent to each other, each of the first and the second containers comprising respective closed ends and respective open ends and defining respective and separate storage chambers for storing therein the perishable contents; and a connector interposed and connected to the first and second connectors for connecting the first and second containers; wherein the closed end of the first container is adjacent to the open end of the second container and the open end of the first container is adjacent the closed end of the second container; wherein the first and second containers are offset relative to each other providing for the open end of the first container to be positioned outwardly relative to the closed end of the second container and for the open end of the second container to be positioned outwardly relative to the closed end of the first container.

In an embodiment, each of the first and second containers comprises a removable enclosure cover for sealing thereof, wherein the relative offset provides a clearance for the removable enclosure cover.

In an embodiment, the connector between the at least one pair of first and second containers is made of rigid material. In an embodiment, the connector between the at least one pair of first and second containers is made of flexible material. In an embodiment, the connector between the at least one pair of first and second containers is integral to the first and second containers. In an embodiment, the connector between the at least one pair of first and second containers is removably mountable to the first and second containers. In an embodiment, the connector between the at least one pair of first and second containers comprises an air channel therethrough.

In an embodiment, the container assembly comprises a plurality of the pair of first and second containers.

In accordance with an aspect of the present disclosure, there is provided a container kit comprising the container of hereinabove described and the container assembly hereinabove described.

In an embodiment, the perishable contents comprise herbs. In an embodiment, the herbs comprise cannabis.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Figure 1:
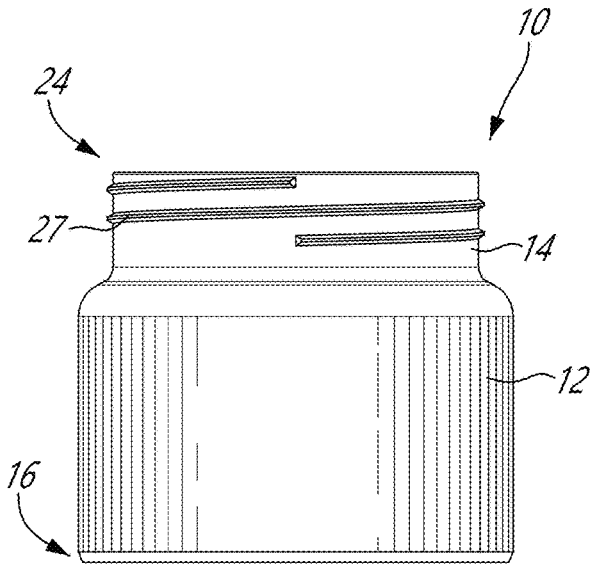
FIG. 1 is a front side view of the container for storing perishable contents in accordance with a non-restrictive illustrative embodiment of the present disclosure, the rear, and lateral sides thereof being the same as the front side view shown.
Figure 2:
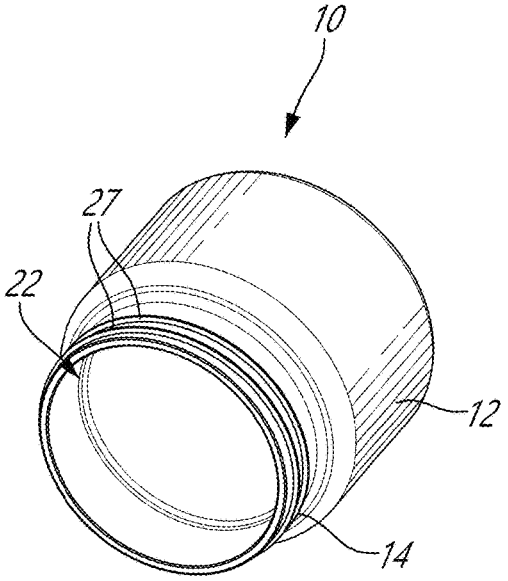
FIG. 2 is a perspective view of the top and side view of the container of FIG. 1.
Figure 3:
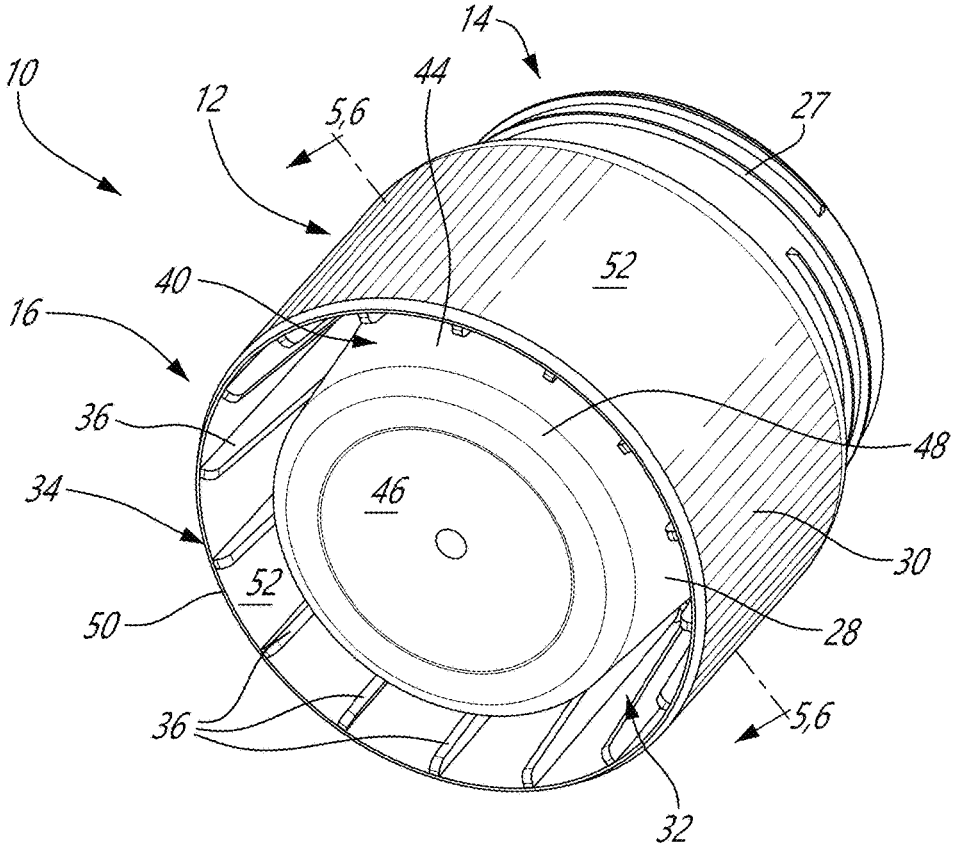
FIG. 3 is a perspective view of the bottom and side of the container of FIG. 1.

Generally stated and in accordance with an aspect of the present disclosure, there is provided a container for storing perishable contents such as herbs including cannabis. The container comprises an inner storage chamber for receiving the perishable contents therein. The inner storage chamber defines top and bottom ends thereof. The inner storage chamber comprises a floor at the bottom end thereof and an inner wall extending from the floor towards an opening at the top end thereof. The floor and the inner wall define a storage cavity therebetween. An outer wall covers the inner wall and downwardly extends from a junction therewith at or near the top end of the storage chamber towards its bottom edge tat or near the bottom end of the storage chamber. The outer wall and the inner wall are spaced apart and define an air channel therebetween for receiving air. The bottom edge of the outer wall and the floor the storage chamber define an opening therebetween leading to the air channel. The air channel provides for allowing a layer of air between the outer wall and inner wall to act as insulation for the perishable contents. In an embodiment, the container further comprises interconnectors between the outer wall and inner wall. In an embodiment, the container further comprises a spout at the top end of storage defining the opening leasing to the storage cavity.

With reference to FIGS. 1 to 7, non-restrictive illustrative embodiments will be described to further exemplify the disclosure only and by no means limit the scope thereof.

The container 10 a main container section 12 and a spout 14. The main container section 12 upwardly extends from the bottom end 16 of the container 10 which engages a surface and is contiguous with spout 12 forming a shoulder 18 at a junction 20 thereof. The spout 14 circumscribes an opening 22 at the top end 24 of the container. The opening 22 leads to the internal storage cavity 26 of the container 10 for storing perishable contents such as herbs including cannabis for example. The spout 14 includes external threads 27 for releasable mutual interference engagement with covers including complementary threads (as discussed further below).

The main container section 12 comprises a pair of concentric and spaced apart inner and outer walls, 28 and 30, defining an air channel 32 therebetween. The walls 28 and 30 merge at a top end 20 thereof defined by the shoulder 18 and define an opening 34 therebetween at the bottom end 16 of the container 12. A plurality of spaced apart interconnectors or ribs 36 positioned within the air channel adjoin the inner and outer walls 28 and 20 at spaced apart respective contact points 37' and 37" therebetween.

The inner wall 28 upwardly extends from a floor 38 which together form the inner storage chamber 40 that defines the internal storage cavity 26. The storage chamber 40 has a top end that is contiguous with the spout 14 and thus the top end 14 of the container 10 is the end thereof. The floor 38 of the storage chamber 40 defines the bottom end 16 thereof. The inner wall 28 and the floor 38 define contiguous inner surface 42 which forms the boundary of the storage cavity 26. The inner wall 28 defines an outer surface 44 and the floor 38 defines an outer floor wall surface 46. Surfaces 44 and 46 merge at junction edge 48. The floor wall surface 46 engages the surfaces on which the container 10 is positioned.

The outer wall 30 defines a bottom edge 50 that also engages the surfaces on which the container 10 is positioned. The opening 34 leading to the air channel 32 is defined between the edges 48 and 50 or generally between the floor 38 and the edge 50. The outer wall 30 defines an inner surface 52 which interfaces with the outer surface 44 of the inner wall 28. Surfaces 44 and 52 merge at junction 20 and define the boundary of the air channel 32. The outer wall 30 defines an outer surface 54 which is the outer surface of the main container section 12.

The ribs 36 are wing like structures with lager upper parts 36A which extend between the surfaces 44 and 52 including at the junction 20 thereof and receding lower parts 36B which are not connected to surface 44 but only along surface 52 defining a free vertically extending edge 55 that recedes further away (in a diagonal fashion) from surface 44 as part 36B extend towards bottom edge 50. Likewise, the wall 28 is tapered as it extends from the extension towards the floor 38. Each wing like rib 36 defines opposite faces 56A and 56B. Thus, the air channel 32 has empty section 58 between the ribs 36 and a contiguous pathway 60 beneath the upper parts 36B. The ribs 36 also define respective bottom rib edge 51 at or near bottom edge 50.

The foregoing structure provides for a pair of thinner walls 28 and 30 which are provided with additional sturdiness by the interconnecting ribs 36. The foregoing structure allows for a cleaner, faster, and more stable injection moulding process. Thus, a higher number of containers can be produced at a higher rate. structure injection molding process in order to make the present container 10.

Moreover, the air channel 32 provided by the spaced apart walls 28 and 30 improves the freshness and shelf life of herbs contained with the storage chamber 40. Indeed, the air channel 32 protects the contents inside the container 10 from external environment factors. Although several external factors can affect the freshness of the contents in the container 10 and thereby the maximum lifespan of these contents, water vapour is usually the main source that can affect the life and freshness of the herbs. Water vapour infiltration is usually caused by airborne moisture and diffusion. Indeed, air passing through each small hole or crack within the wall of a container contains moisture (i.e. water vapour) that seeps into the container and cannot escape coming into contact with the herbs.

Diffusion is caused by a difference in moisture on either side of the container (external or internal); water vapour simply passes through the container wall. Some materials may have more airtight properties than others, but no material is 100% water-vapour tight.

The air channel 32 defined by the spaced apart walls 28 and 30 having an opening 34 at one end and being closed at the junction 20 limits airborne moisture from entering the storage chamber and diffusion between the storage cavity 26 and the air channel 32 or the ambient environment. The present structure adds a layer of air to the container 10. Indeed, the air channel 32 is usually partially (but not hermetically) sealed when the container is on a surface and the opening 34 is closed. This added layer acts as an insulator between the inner and outer walls 28 and 30 thus reducing the water vapor transmission ratio and lengthening the life cycle of the herbs which increases the freshness time period.

Figure 9:
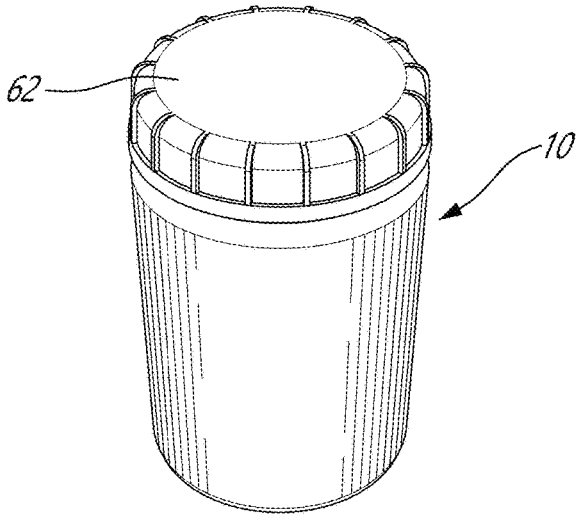
FIG. 9 is a perspective top view of a container of FIG. 1 with an enclosure cover in accordance with a non-restrictive illustrative embodiment of the present disclosure.
Figure 10:
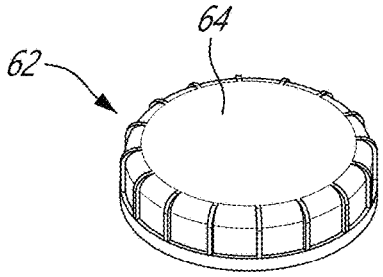
FIG. 10 is a top perspective view of the cover of the container shown in FIG. 10.
Figure 11:
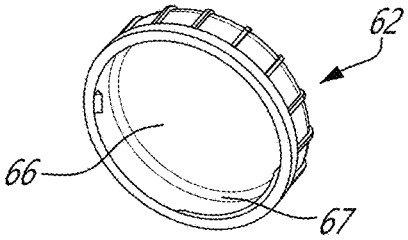
FIG. 11 is a bottom perspective view of the cover of FIG. 10.

Turning now to FIGS. 9, 10 and 11, the container 10 is enclosed via an enclosure cover 62 such as a cap. The cover 62 defines inner and outer sides, 64 and 66, respectively and includes inner threads 67 which are complementary to external threads 27 of the spout 14 for releasable mutual interference engagement therewith.

Figure 4:
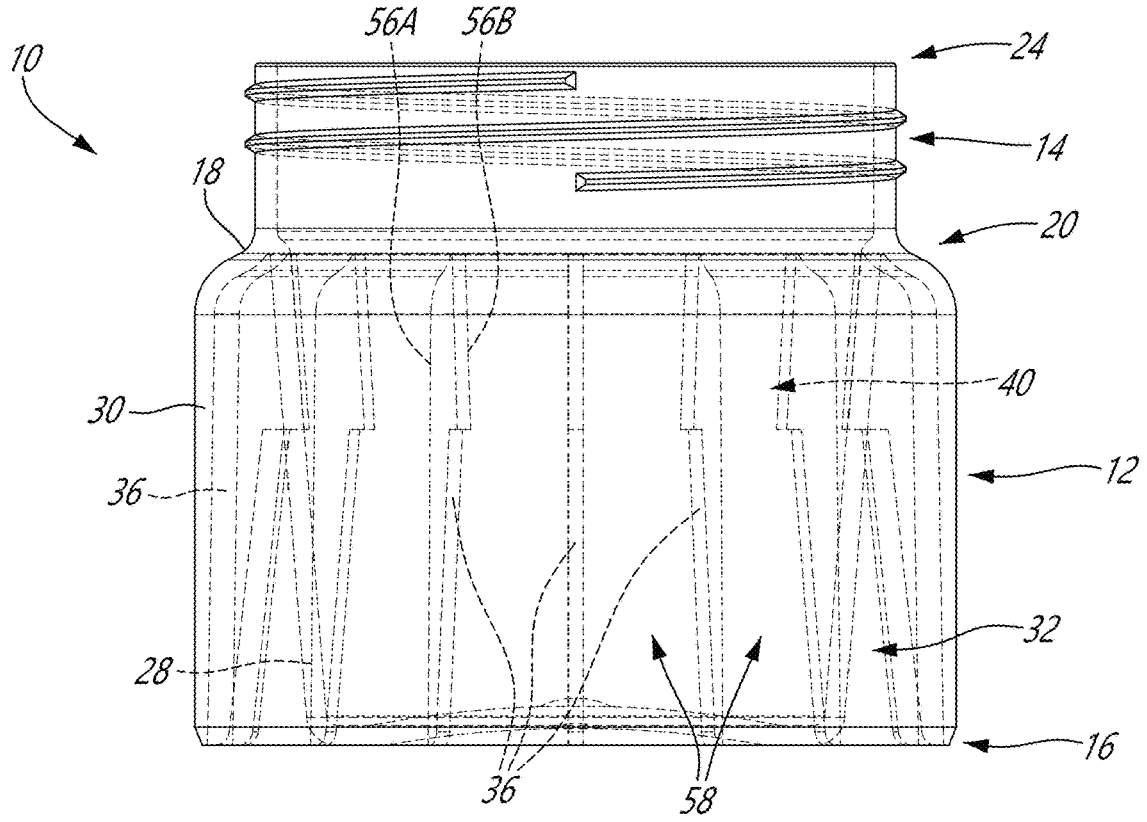
FIG. 4 is a partially transparent front view of the container of FIG. 1.
Figure 5:
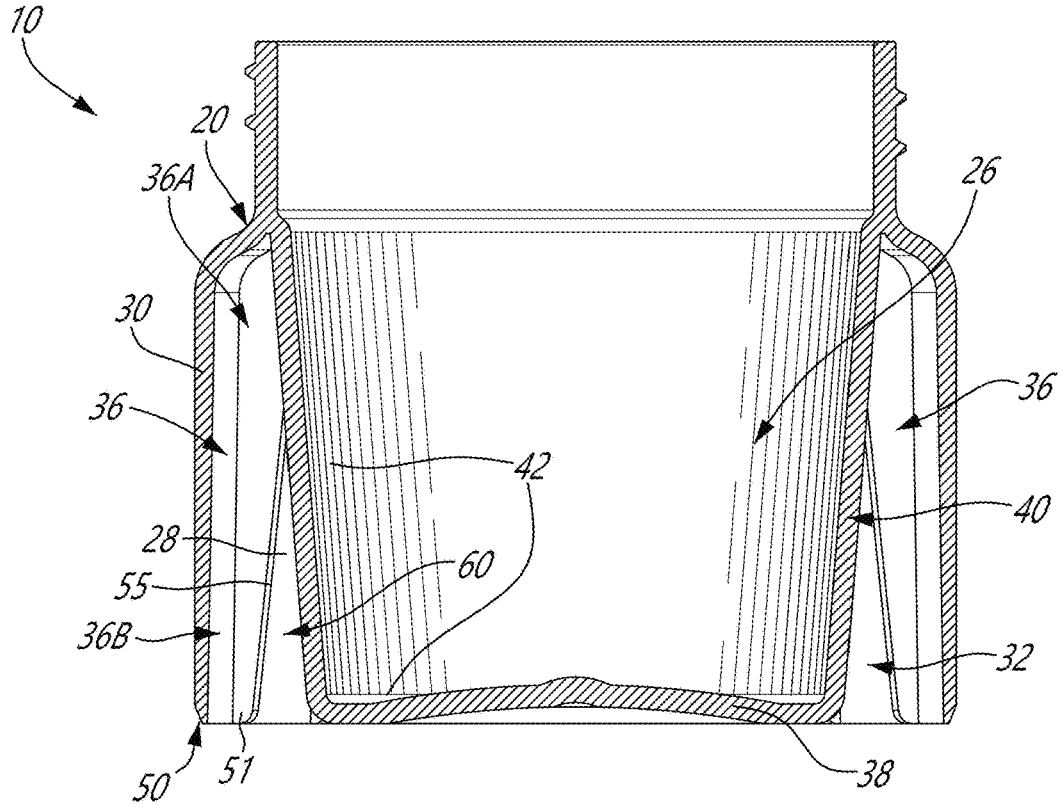
FIG. 5 is sectional view of the container for storing perishable contents in accordance with a non-restrictive illustrative embodiment of the present disclosure taken along line 5-5 of FIG. 1.
Figure 6:
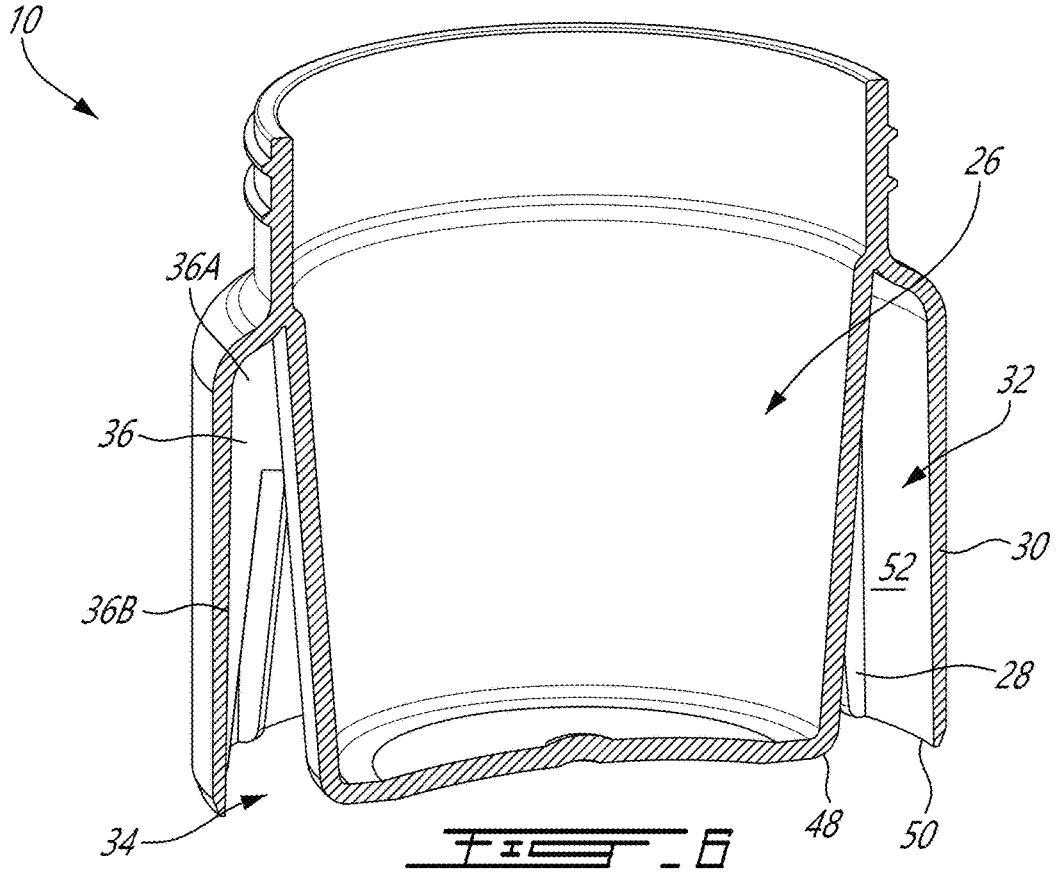
FIG. 6 is sectional view of the container for storing perishable contents in accordance with a non-restrictive illustrative embodiment of the present disclosure taken along line 6-6 of FIG. 1.
Figure 7:
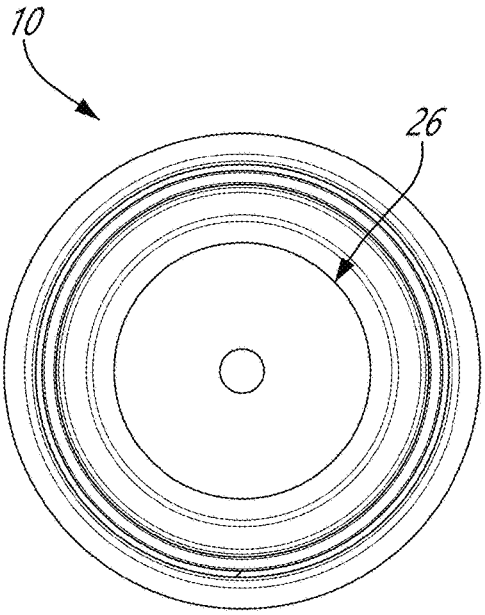
FIG. 7 is a top plan view of the container of FIG. 1.
Figure 8:
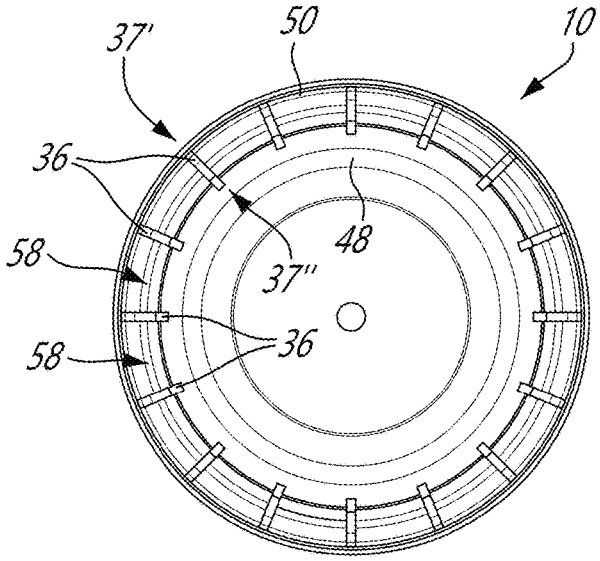
FIG. 8 is a bottom view of the container of FIG. 1.
Figure 12:
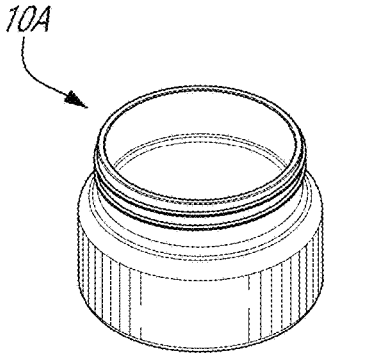
FIG. 12 is a top perspective view of a container for storing perishable contents in accordance with another non-restrictive illustrative embodiment of the present disclosure.
Figure 13:
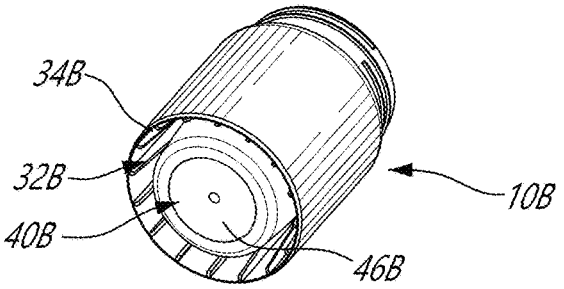
FIG. 13 is a top perspective view of a container for storing perishable contents in accordance with a further non-restrictive illustrative embodiment of the present disclosure.
Figure 14:
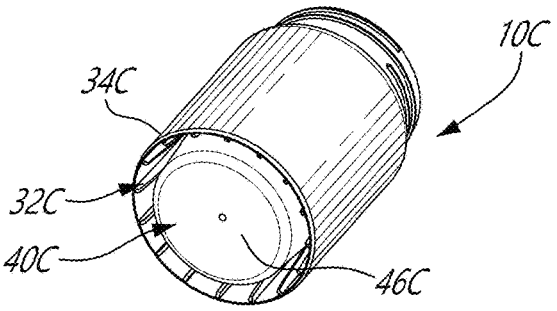
FIG. 14 is a top perspective view of a container for storing perishable contents in accordance with yet another non-restrictive illustrative embodiment of the present disclosure.

The containers for perishable goods herein can be provided in a variety of different sizes, configurations and dimensions as can be contemplated by the skilled artisan. For example, FIGS. 12, 13 and 14 show container 10A, 10B and 10C having different heights and widths. Moreover, container 10B and 10C are shown with respective storage chambers, 40B and 40C, with respective acutely tapered and subtlety tapered shapes in the direction of their respective bottom surfaces 46B and 46C. The configuration of chamber 40B provides an air channel 32B is a relatively wider openings 34B and the configuration of chamber 40C provides for an air channel 32C with a relatively narrower opening 34C. In an embodiment, the air channels 32B and 32C become narrower in the direction leading to junction 20 (as discussed for container 10 and as shown in FIGS. 4 and 5). Of course, the air channels may have the same width along their length about the storage chamber.

Figure 15:
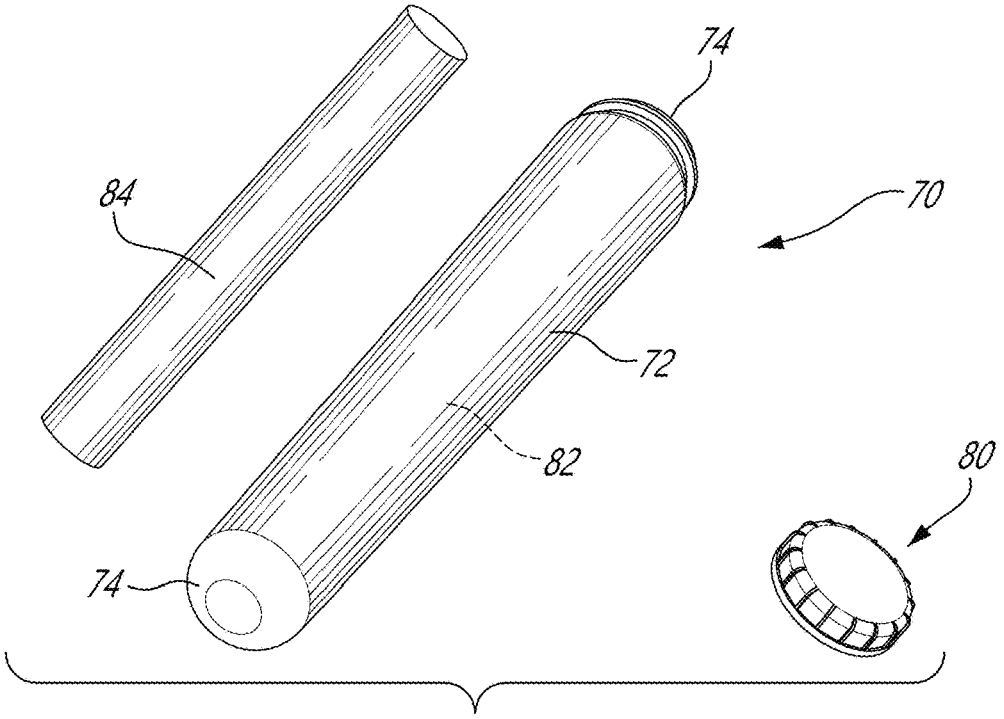
FIG. 15 is a perspective view of a container for storing a rolled smokable cylinder of burnable material in accordance with a non-restrictive illustrative embodiment of the present disclosure.

FIG. 15 shows a container 70 for a rolled smokable cylinder of burnable material such as a cigarette with tobacco and/or cannabis also colloquially referred to as a joint, a spliff etc.

The container 70 is a narrow longitudinal cylinder body 72 having a closed end 74 and open opposite end 76 defining an opening 78 (see FIG. 16) closable by a closure cover 80. The opening 78 leads to a tubular chamber 82 for receiving therein the closed smokable cylinder 84 of burnable material. The cylinder body 72 is tapered from its open end 76 to its closed end 74, this the open end 76 is larger than the closed end 74.

Figure 16:
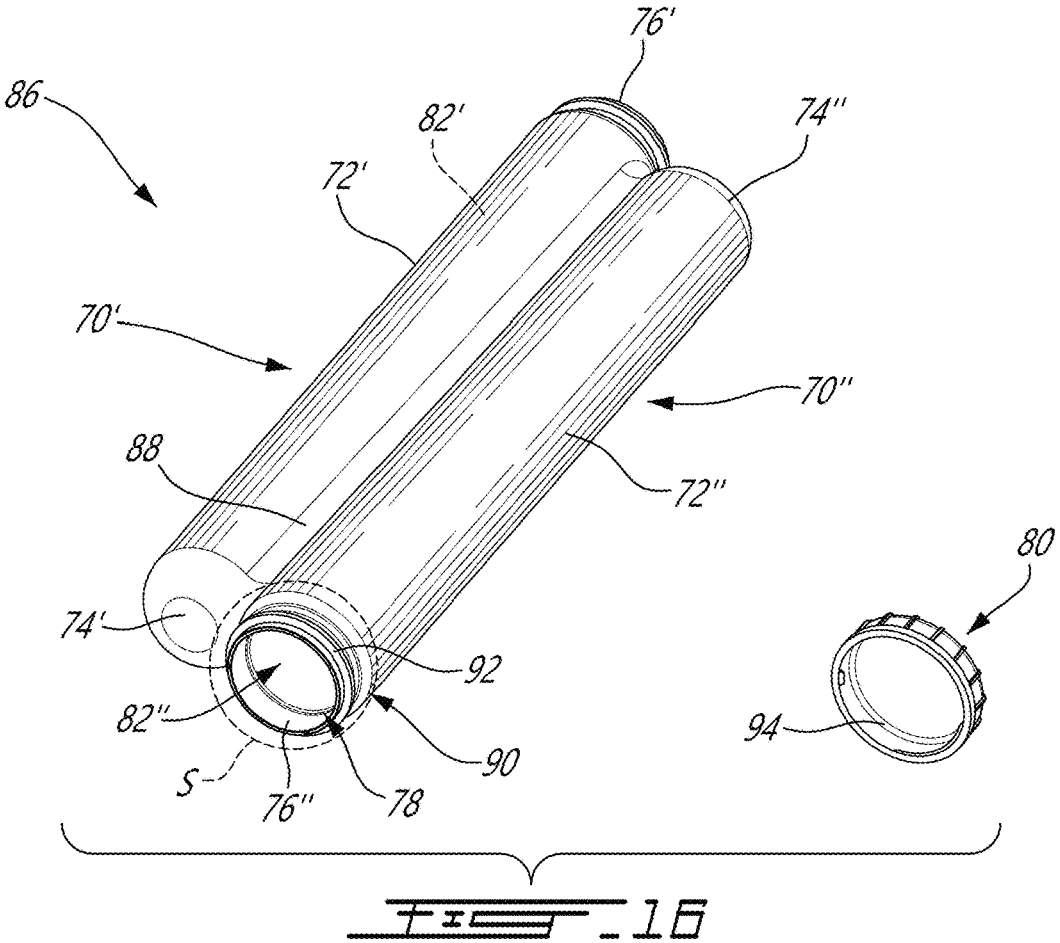
FIG. 16 is a perspective view of a container assembly for storing a pair of rolled smokable cylinders of burnable material in accordance with a non-restrictive illustrative embodiment of the present disclosure.

FIG. 16 shows a container assembly 86 for smokable cylinders such as cigarettes, joints etc. The container 86 comprises a pair of containers 70' and 70', joined together along their respective cylinder bodies 72' and 72" by way of a connector 88 therebetween. It is to be understood, that containers 70' and 70" are substantially similar to container 70 and thus the description of container 70 applies to containers 70' and 70" mutatis mutandis and is not repeated here for concision purposes only. The end containers 70' and 70" are oppositely positioned with respect to each other such that the closed end 74' of container 70' is adjacent the open end 76" of container 70" and the closed end of 76' of container 70' is adjacent the open end 74" of container 70". The containers 70' and 70" are offset relative to each other along their longitudinal length such that the closed end 74' of container 70' is recessed relative the open end 76" of container 70" adjacent thereto which extends beyond the position of the closed end 74'. Similarly, the closed end 74" of container 70" is recessed relative to the open end 76' of container 70" adjacent thereto which extends beyond the position of the closed end 74". This foregoing offset and alternating end arrangement between a pair of containers 70' and 70" is shown to be a repeated pattern in the container assembly 96 of FIG. 17 which will be discussed further below. Indeed, the arrangement between containers 70' and 70" along with the space between the containers 70' and 70" provided by the connector 88 therebetween allows for clearance space S for a closure cover 80 to be fitted onto the open ends 76' or 76". As shown, the spout 90 of the open end 76" includes threads 92 for a mutual interference fit with the complementary inner threads 94 of the cover 80.

Providing separate chambers 82' and 82" sealed from each other allow to maintain greater freshness of the material therein. Moreover, a partially smoked cigarette can be re-inserted in its chamber to be smoked later without contacting other cigarettes.

Figure 17:
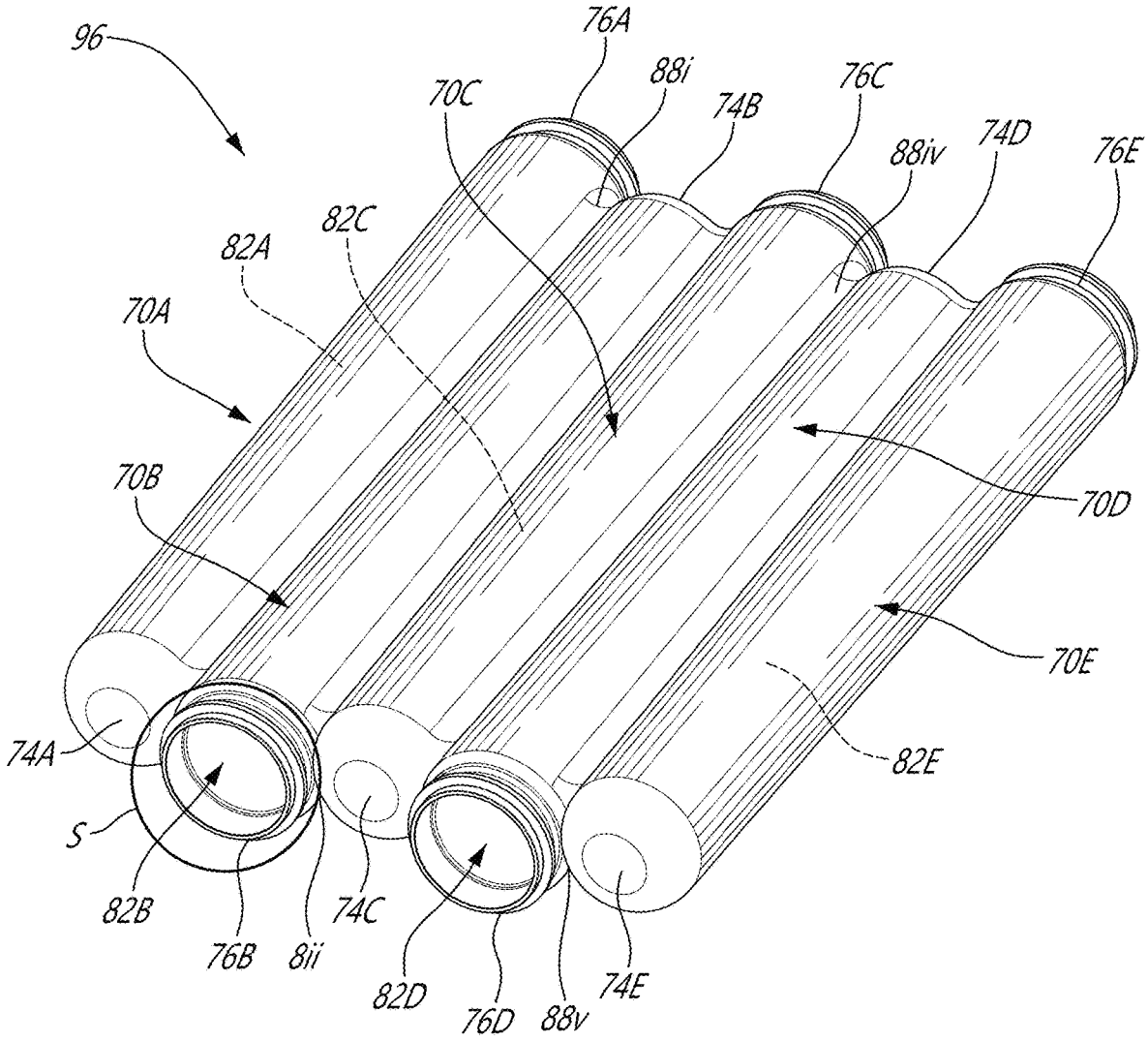
FIG. 17 is a perspective view of a container assembly for storing a plurality of rolled smokable cylinders of burnable material in accordance with a non-restrictive illustrative embodiment of the present disclosure.

As shown in FIG. 17, a container assembly 96 includes a plurality of containers 70A, 70B, 70C, 70D, 70E all of which are similar to constructed to container 70 and define respective separate chambers 82A, 82B, 82C, 82D, 82E. Each pair of adjacent pair of containers: 70A and 70B; 70B and 70C; 70C and 70D; and 70D and 70E are respectively interconnected by connectors: 88*i*; 881*i*; 88*iii*; and 881*v*, interposed between each of the container pairs. Each of the container pairs are arranged in the same alternating side by side and offset position, with each open end being adjacent a closed end of the adjacent container and vice versa and with each containers of an adjacent pair being offset so as to provide the clearance space S.

In an embodiment, the connectors 88, 88*i*, 88*ii*, 88*iii*, and 88*iv* are solid bodies integrated to the containers they join together. In another embodiment, the connectors comprise air channels. In yet another embodiment, these connectors are malleable or flexible to allow the user to bend the area defined by a connector. In another embodiment, the connectors are separate body portions for selectively and releasabley interconnecting a pair of containers together.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. A container for storing perishable contents comprising:

an inner storage chamber for receiving the perishable contents therein, the inner storage chamber defining top and bottom ends and comprising a floor at the bottom end thereof, an inner wall extending from the floor towards an opening at the top end thereof, the floor and the inner wall defining a storage cavity therebetween;

an outer wall covering the inner wall and downwardly extending from a junction therewith at the top end of the storage chamber towards a bottom edge thereof at the bottom end of the storage chamber, the outer wall and the inner wall being spaced apart so as to define an air channel therebetween for receiving air, the bottom edge of the outer wall and the floor of the storage chamber being horizontally aligned and defining an opening therebetween leading to the air channel; and a plurality of equally spaced apart wing-like interconnectors vertically extending between the outer wall and inner wall and along a full length of the outer and inner walls defining opposite flat faces and comprising an upper part thereof connected to the inner wall and a lower part thereof that is not connected to the inner wall, the lower part being longer than the upper part, the lower part extending from the upper part and defining a free vertical edge thereof interfacing with the inner wall and progressively and diagonally receding away from the inner wall towards a free bottom edge thereof at the bottom edge of the outer wall, the inner and outer walls comprising relatively thin and flexible material, the interconnectors providing additional sturdiness to the inner and outer walls, the upper part being fully connected to the inner wall providing greater sturdiness between the outer and inner walls than the lower part, wherein the air channel is defined by empty sections between the interconnectors and a contiguous pathway beneath the upper parts thereby providing for allowing a layer of air between the outer wall and inner wall to act as insulation for the perishable contents, wherein insulation is further provided by heat on the outer wall being absorbed by the lower parts of the interconnectors which are not connected to the inner wall thereby avoiding direct heat transfer thereto.

2. A container according to claim 1, further comprising a spout at the top end of storage defining the opening leading to the storage cavity.

3. A container according to claim 2, wherein the opening is releasably sealable by a closure cover.

4. A container according to claim 1 wherein the air channel size expands along the length of the inner storage chamber from a position near or at the junction to a position near or at the bottom edge thereof at or near the bottom end of the storage chamber.

5. A container according to claim 1, wherein the air channel size is similar along the length of the inner storage chamber from a position at the junction to a position at the bottom edge thereof at the bottom end of the storage chamber.

* * * * *